US006675754B2

(12) United States Patent
Watanabe et al.

(10) Patent No.: US 6,675,754 B2
(45) Date of Patent: Jan. 13, 2004

(54) VALVE TIMING CONTROL APPARATUS

(75) Inventors: Masahiko Watanabe, Yokohama (JP); Naotaka Nakura, Kanagawa (JP)

(73) Assignee: Hitachi Unisia Automotive, Ltd., Atsugi (JP)

( * ) Notice: Subject to any disclaimer, the term of this patent is extended or adjusted under 35 U.S.C. 154(b) by 0 days.

(21) Appl. No.: 10/267,866

(22) Filed: Oct. 10, 2002

(65) Prior Publication Data

US 2003/0070643 A1 Apr. 17, 2003

(30) Foreign Application Priority Data

Oct. 12, 2001 (JP) ..... 2001-315061

(51) Int. Cl.[7] ..... F01L 1/34

(52) U.S. Cl. ..... 123/90.17; 123/90.15; 123/90.31

(58) Field of Search ..... 123/90.17, 90.31, 123/90.15

(56) References Cited

U.S. PATENT DOCUMENTS 6,502,537 B2 * 1/2003 Todo et al. ..... 123/90.17
6,510,826 B2 * 1/2003 Watanabe ..... 123/90.17
6,561,149 B1 * 5/2003 Kobayashi et al. ..... 123/90.17
6,622,674 B2 * 9/2003 Kobayashi et al. ..... 123/90.15

FOREIGN PATENT DOCUMENTS

JP 2001-41013 2/2001

OTHER PUBLICATIONS

U.S. patent application Ser. No. 10/267,678, Hibi et al., filed Oct. 10, 2002.

U.S. patent application Ser. No. 10/267,864, Todo et al., filed Oct. 10, 2002.

U.S. patent application Ser. No. 10/267,776, Watanabe et al., filed Oct. 10, 2002.

* cited by examiner

*Primary Examiner*—Thomas Denion
*Assistant Examiner*—Zelalem Eshete
(74) *Attorney, Agent, or Firm*—Foley & Lardner

(57) ABSTRACT

A valve timing control apparatus including a drive rotary member, a driven rotary member and an intermediate rotary member rotatable relative to the drive and driven rotary members. A follower is moveably engaged with a radial guide of one of the drive and driven rotary members and a spiral guide of the intermediate rotary member. An actuator rotates the intermediate rotary member to allow a movement of the follower along the radial guide which is converted into relative rotation of the drive and driven rotary members via a link coupling the follower with the other of the drive and driven rotary members. A lubricating oil chamber is arranged to surround an engagement portion between the spiral guide and the follower and pivotal connection portions between one end of the link and the other of the drive and driven rotary members and between an opposite end thereof and the follower.

24 Claims, 13 Drawing Sheets

29
36s
36n
36s
36n
S
N
S
N
S
N

VALVE TIMING CONTROL APPARATUS

BACKGROUND OF THE INVENTION

The present invention relates to a valve timing control apparatus for variably controlling opening and closing timings of an engine valve, i.e., an intake valve and an exhaust valve, of an internal combustion engine depending on operating conditions of the engine.

Such a valve timing control apparatus is so designed as to control the opening and closing timings of the engine valve by varying a relative rotational phase of a crankshaft and a camshaft. The relative rotational phase of the crankshaft and the camshaft is adjusted by operating a phase adjustor. The phase adjustor is disposed between a drive rotary member operatively coupled with the crankshaft and a driven rotary member disposed on the camshaft side. Recently, there have been proposed various kinds of phase adjustors utilizing a gearing including a helical gear, a linkage or the like. The phase adjustor using the linkage is advantageous in lessening an axial length of the phase adjustor and reducing friction loss thereof.

Japanese Patent Application First Publication No. 2001-41013 discloses a valve timing control apparatus including such a phase adjustor using the linkage. FIGS. 14 and 15 show the valve timing control apparatus of the related art. As illustrated in FIGS. 14 and 15, housing 101 as a drive rotary member is rotatably fitted onto an end portion of camshaft 102. Housing 101 is drivably connected to an engine crankshaft via a timing chain. A plurality of followers 104 are slidably engaged in radial guide grooves 103 formed in an axial end surface of housing 101. Lever shaft 106 as a driven rotary member is mounted to the end portion of camshaft 102. A plurality of levers 105 radially outward projecting from lever shaft 106 are connected with the corresponding followers 104 via links 107. Levers 105 and followers 104 are pivotally supported at opposite ends of links 107, respectively. Intermediate rotary member 109 is disposed in opposed relation to the axial end surface of housing 101 in which radial guide grooves,103 are formed, and supported on inner support rod 113 so as to be rotatable relative to housing 101 and lever shaft 106. Intermediate rotary member 109 has spiral guide groove 108 in the end surface opposed to radial guide grooves 103. A plurality of arcuate projections 110 projecting from an axial end face of each of followers 104 are engaged with spiral guide groove 108 and guided therealong. When electromagnetic brake 112 is deenergized, intermediate rotary member 109 is biased by spring 111 to be urged toward an advanced rotational position. In this position, followers 104 are placed at the radially outer-most position in the respective radial guide grooves 103, in which the relative rotational phase between housing 101 and camshaft 102 is held most retarded or most advanced. Further, when electromagnetic brake 112 is energized, intermediate rotary member 109 is decelerated by the action of electromagnetic brake 112 toward a retarded rotational position. In this position, followers 104 are moved to the radially inner position, so that the relative rotational phase between housing 101 and camshaft 102 is held most advanced or most retarded. Lubricating oil supply passage 120 extends along camshaft 102 and is open to an axial end face of camshaft 102. Lubricating oil is supplied to links 107 and mutually engaging portions of followers 104 and spiral guide grooves 108 via lubricating oil supply passage 120.

SUMMARY OF THE INVENTION

In such a valve timing control apparatus as described above, the lubricating oil flows outside from the clearance between housing 101 and intermediate rotary member 109 so that links 107 and the mutually engaging portions of followers 104 and spiral guide grooves 108 are not always immersed in the lubricating oil. Therefore, there is a demand to ensure sufficient lubrication at links 107 and the mutually engaging portions of followers 104 and spiral guide grooves 108. In addition, slight clearances are formed between the pivotal connections of links 107 to levers 105 and between the mutually engaging portions of followers 104 and spiral guide grooves 108 for the purpose of obtaining smooth motions thereof. There is a demand to prevent occurrence of vibration and noise at the slight clearances.

In one aspect of the present invention, there is provided a valve timing control apparatus for an internal combustion engine, comprising:

- a drive rotary member adapted to be rotatively coupled with the engine;
- a driven rotary member rotatably coupled with the drive rotary member;
- an intermediate rotary member arranged to be rotatable relative to the drive rotary member and the driven rotary member;
- a radial guide extending on one of the drive rotary member and the driven rotary member in a radial direction thereof;
- a spiral guide disposed on the intermediate rotary member in an opposed relation to the radial guide;
- a follower moveably engaged with the radial guide and the spiral guide;
- a link coupling the follower with a radially outer periphery of the other of the drive rotary member and the driven rotary member, the link comprising one end pivotally connected with the radially outer periphery of the other of the drive rotary member and the driven rotary member and an opposite end pivotally connected with the follower;
- an actuator operative to rotate the intermediate rotary member so as to allow a movement of the follower along the radial guide which is converted into relative rotation of the drive rotary member and the driven rotary member via the link; and
- a lubricating oil chamber arranged to surround an engagement portion between the spiral guide and the follower and pivotal connection portions between the one end of the link and the radially outer periphery of the other of the drive rotary member and the driven rotary member and between the opposite end of the link and the follower, the lubricating oil chamber being adapted to be filled with lubricating oil.

In a further aspect of the present invention, there is provided a valve timing control apparatus for an internal combustion engine, comprising:

- a drive rotary member adapted to be rotatively coupled with the engine;
- a driven rotary member rotatably coupled with the drive rotary member;
- an intermediate rotary member arranged to be rotatable relative to the drive rotary member and the driven rotary member;
- a radial guide extending on one of the drive rotary member and the driven rotary member in a radial direction thereof;
- a spiral guide disposed on the intermediate rotary member in an opposed relation to the radial guide;

a follower moveably engaged with the radial guide and the spiral guide;

a link coupling the follower with a radially outer periphery of the other of the drive rotary member and the driven rotary member, the link comprising one end pivotally connected with the radially outer periphery of the other of the drive rotary member and the driven rotary member and an opposite end pivotally connected with the follower;

an actuator operative to rotate the intermediate rotary member so as to allow a movement of the follower along the radial guide which is converted into relative rotation of the drive rotary member and the driven rotary member via the link; and a lubricating oil chamber arranged to surround an engagement portion between the spiral guide and the follower and pivotal connection portions between the one end of the link and the radially outer periphery of the other of the drive rotary member and the driven rotary member and between the opposite end of the link and the follower, the lubricating oil chamber being adapted to be filled with lubricating oil and supplied with an amount of lubricating oil larger than an amount of lubricating oil leaking therefrom.

In a still further aspect of the present invention, there is provided a valve timing control apparatus for an internal combustion engine, comprising:

a drive rotary member adapted to be rotatively coupled with the engine;

a driven rotary member rotatably coupled with the drive rotary member;

an intermediate rotary member arranged to be rotatable relative to the drive rotary member and the driven rotary member;

phase adjusting linkage means for coupling the drive rotary member and the driven rotary member and adjusting a relative rotational phase of the drive rotary member and the driven rotary member;

actuator means for operating the intermediate rotary member to allow the adjustment of the relative rotational phase via the phase adjusting linkage means; and wall means for defining a lubricating oil chamber in cooperation with the intermediate rotary member and one of the drive rotary member and the driven rotary member, the phase adjusting linkage means is disposed within the lubricating oil chamber.

Other objects and features of this invention will become understood from the following description with reference to the accompanying drawings.

DETAILED DESCRIPTION OF THE PREFERRED EMBODIMENT

Referring now to FIGS. 1–9, there is shown a valve timing control apparatus according to a first embodiment of the present invention. In this embodiment, the valve timing control apparatus of the invention is applied to a power train of an intake side of an internal combustion engine. The valve timing control apparatus of the invention can also be applied to a power train of an exhaust side of the internal combustion engine.

Figure 1B:
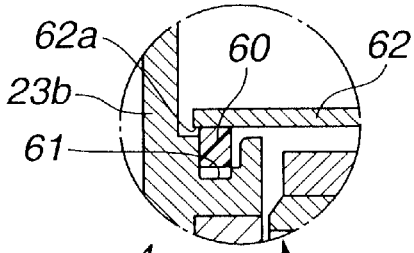
FIG. 1B is an enlarged view of a circled portion of FIG. 1A.
Figure 1A:
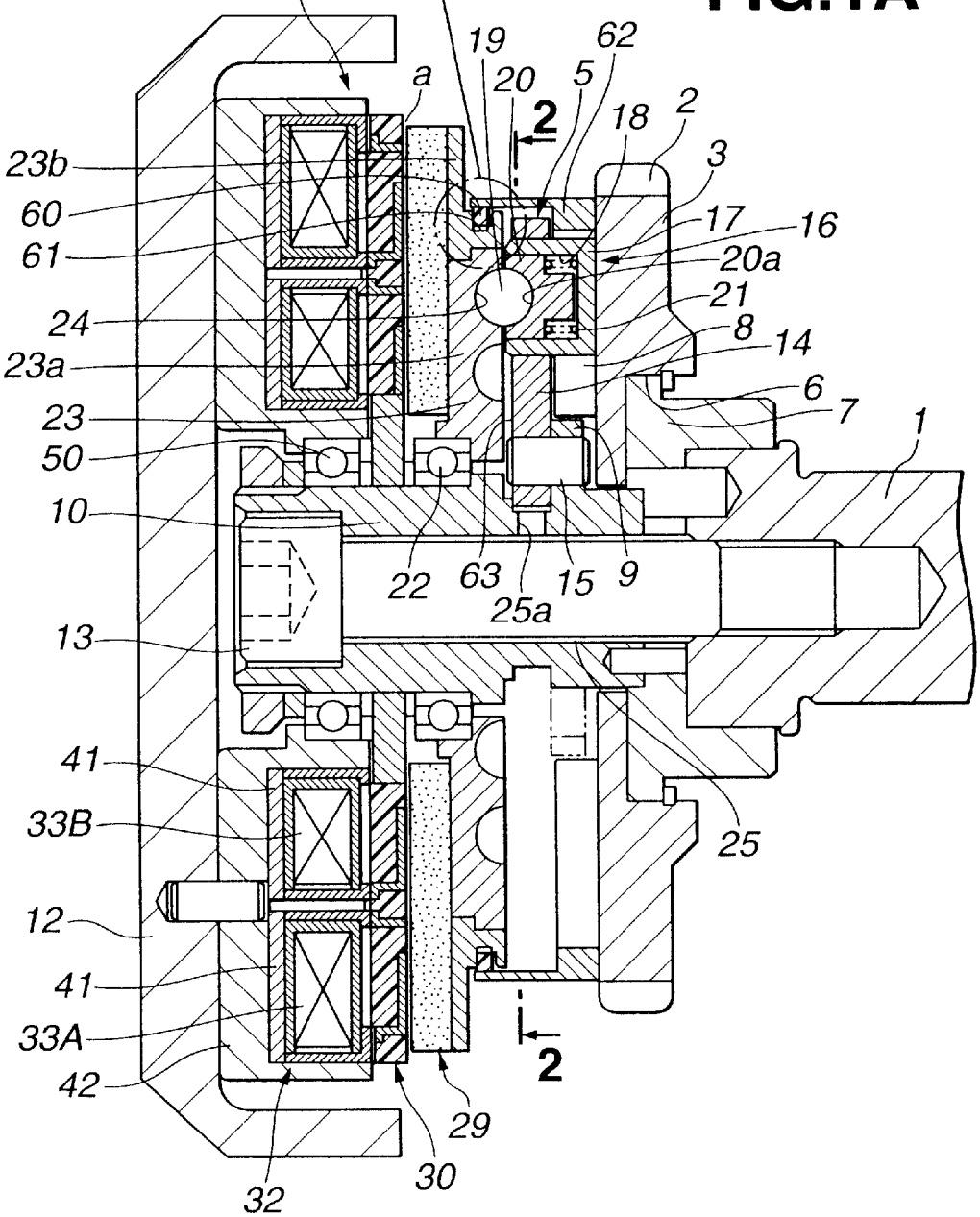
FIG. 1A is a vertical cross-section of a valve timing control apparatus according to a first embodiment of the present invention.

As illustrated in FIG. 1A, the valve timing control apparatus includes camshaft 1 and drive plate 3 rotatably coupled with an axial end portion of camshaft 1 and acting as a drive rotary member. Camshaft 1 is rotatably supported on a cylinder head, not shown, of the engine. Drive plate 3 is formed into a generally annular disk shape having timing sprocket 2 integrally formed on its outer periphery. Drive plate 3 is drivably connected with an engine crankshaft via a chain engaged with timing sprocket 2. Phase adjusting linkage 5 for adjusting a relative rotational phase of drive plate 3 and camshaft 1 is disposed on the side of the axial end portion of camshaft 1, namely, on the left side of camshaft 1 as viewed in FIG. 1A. The left direction in FIG. 1A is referred to as a frontward direction hereinafter. Actuator 4 for driving phase adjusting linkage 5 is disposed on the front side of phase adjusting linkage 5. VTC cover 12 is disposed on the front side of actuator 4 and covers a front surface and an outer circumferential surface of actuator 4. VTC cover 12 extends over respective front portions of the engine cylinder head and a rocker arm cover.

Figure 2:
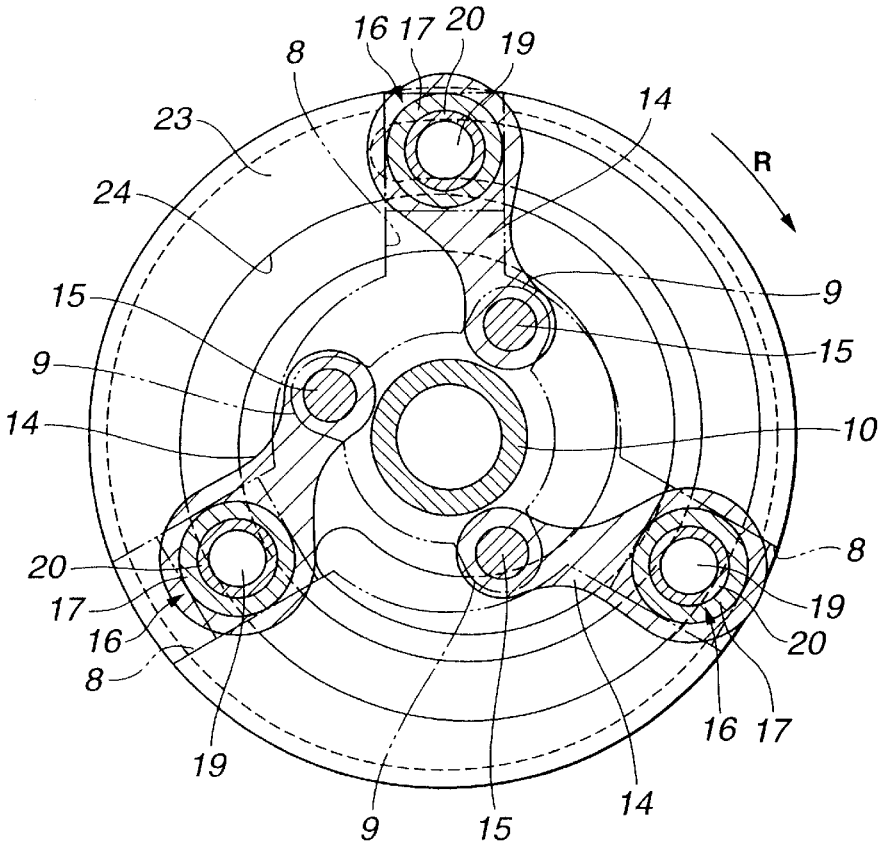
FIG. 2 is a cross-section taken along line 2—2 of FIG. 1A.

Specifically, drive plate 3 is in the form of a disk having stepped bore 6 on a central portion thereof. Drive plate 3 is rotatably supported on flange ring 7 integrally connected with the front end portion of camshaft 1, by engagement of stepped bore 6 with flange ring 7. Stepped bore 6 includes a large-diameter portion engaged with flange ring 7 and a small-diameter portion receiving lever shaft 10 explained later. Radial guide 8 is disposed on drive plate 3, which is provided for guiding followers 16 as explained later. In this embodiment, radial guide 8 is constituted of three guide grooves formed in a front surface of drive plate 3 which is located on the opposite side of camshaft 1. As best shown in FIG. 2, guide grooves 8 radially extend and are equidistantly spaced from each other.

Lever shaft 10 is disposed on the front side of flange ring 7. Lever shaft 10 is coupled with camshaft 1 together with and through flange ring 7 by using bolt 13 and acts as a driven rotary member. As shown in FIG. 2, lever shaft 10 has three levers 9 in the form of projections radially outward extending from an outer peripheral surface of lever shaft 10 and equidistantly spaced from each other. Links 14 are provided corresponding to levers 9. Each of links 14 has one end pivotally supported on each of levers 9 by means of pin 15. Lubricating oil supply passage 25 extends through lever shaft 10 and flange ring 7 into camshaft 1 along a common rotation axis thereof. Lubricating oil supply passage 25 further extends along an outer circumferential surface of a stem of bolt 13. Lubricating oil supply passage 25 has outlet port 25*a* which is open to an outer surface of a radially outer periphery of lever shaft 10 and located near each of levers 9. Lubricating oil is supplied from outlet port 25*a* to the one end of link 14 pivotally connected with lever 9. Link 14 has an opposite end which is pivotally connected with each of followers 16.

Each of followers 16 includes one open-ended cylindrical casing 17 having a rectangular-shaped section shown in FIG. 1. Casing 17 is rotatably fitted to a mount hole formed at the opposite end of link 14, and slidably engaged in radial guide 8 of drive plate 3. Generally cylindrical retainer 20 is slidably disposed within bore 18 of casing 17. Coil spring 21 is mounted to a bottom of casing 17 and biases retainer 20 in the frontward direction. Retainer 20 has half-spherical recess 20*a* at a central portion of a front face of retainer 20. Ball 19 is rotatably engaged in recess 20*a*. Followers 16 are connected with the corresponding levers 9 of lever shaft 10 via links 14 while being kept in engagement with radial guide 8. When a force is applied to followers 16 so as to displace followers 16 along radial guide 8, drive plate 3 and lever shaft 10 connected via links 14 are relatively rotated. The direction and angle of the relative rotation are determined depending on the direction and amount of displacement of followers 16.

Figure 8:
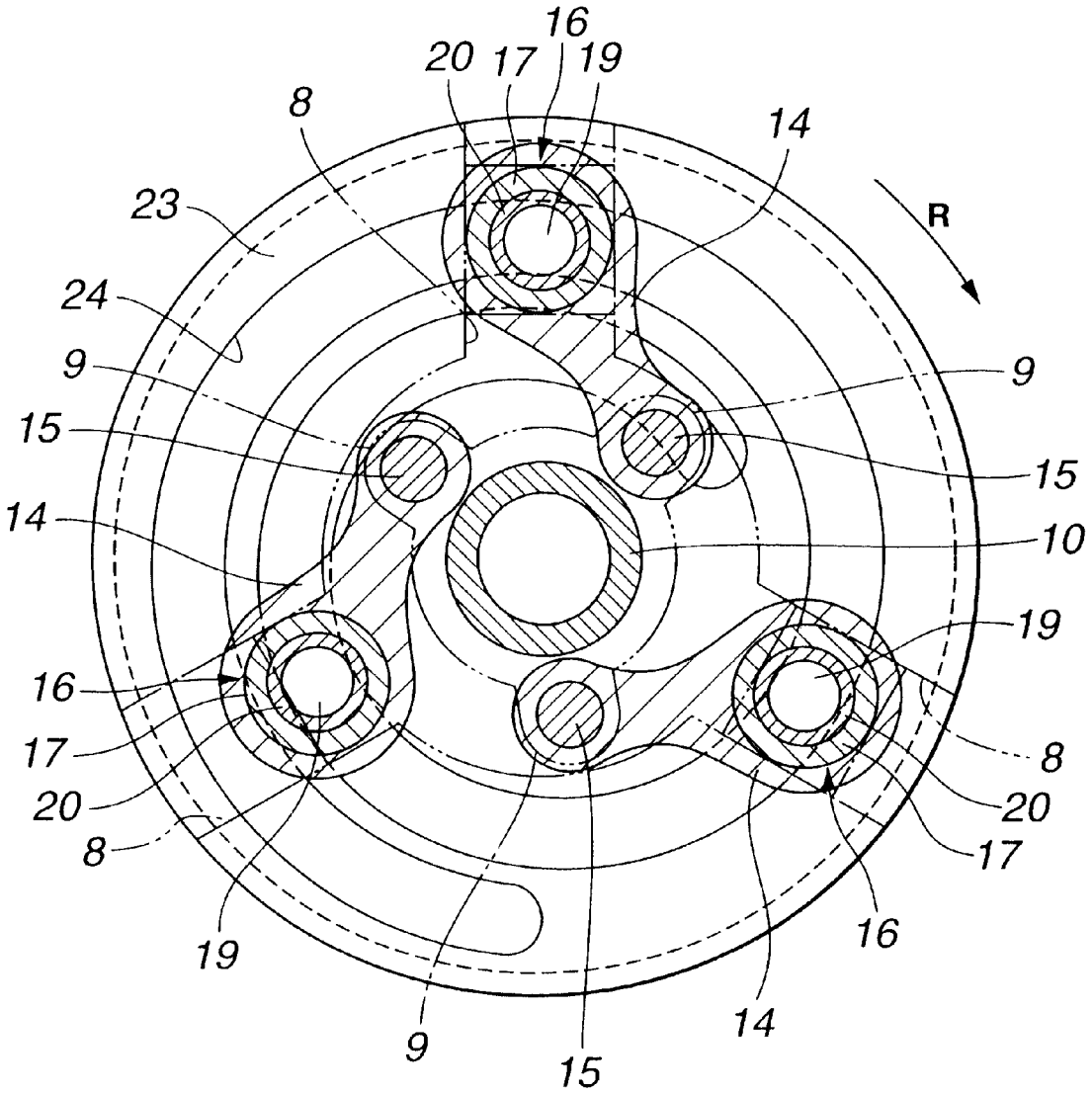
FIGS. 8 and 9 are diagrams similar to FIG. 2, but showing different operating states of the valve timing control apparatus of the first embodiment, respectively.
Figure 9:
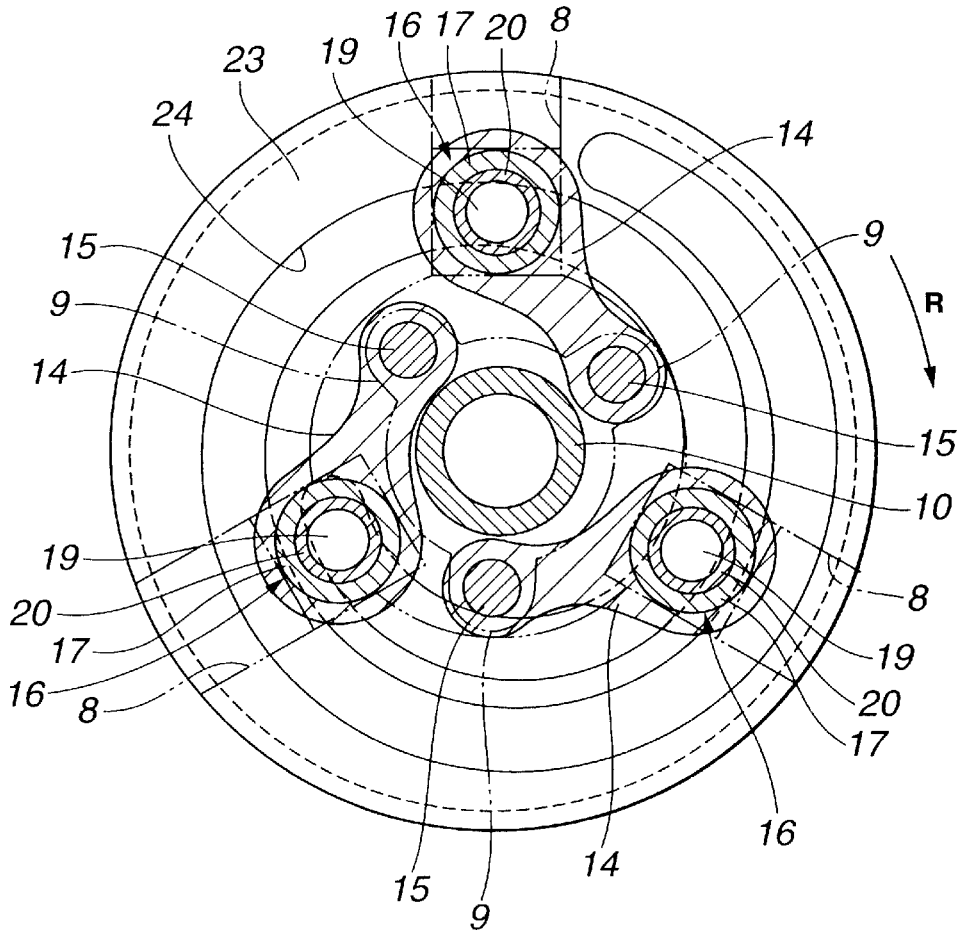

Generally disk-shaped intermediate rotary member 23 is arranged to be rotatable relative to drive plate 3 and lever shaft 10. Intermediate rotary member 23 is rotatably supported on lever shaft 10 on the front side of levers 9 via ball bearing 22. Intermediate rotary member 23 includes main body 23*a* and outer ring 23*b* press-fitted to an outer circumferential surface of main body 23*a*. Spiral guide 24 is disposed on main body 23*a* of intermediate rotary member 23 in opposed relation to the radial guide of drive plate 3. Spiral guide 24 is provided in the form of a spiral groove formed in a rear surface of main body 23*a* which is opposed to the front surface of drive plate 3. Spiral guide 24 has a half-spherical section similar to that of balls 19 of followers 16 and engages balls 19. Balls 19 are rotatably supported between spiral guide 24 and recess 20*a* of retainer 20. The shape of spiral guide 24 is configured such that the diameter is gradually reduced in rotating direction R of drive plate 3 as shown in FIGS. 2, 8 and 9. Owing to the spiral shape, if intermediate rotary member 23 rotates in a retardant direction relative to drive plate 3 while keeping the engagement of spiral guide 24 with balls 19, followers 16 are radially inward displaced along spiral guide 24. Conversely, if intermediate rotary member 23 rotates in an advance direction relative to drive plate 3, followers 16 are radially outward displaced along spiral guide 24.

Phase adjusting linkage 5 is constituted of radial guide 8 of drive plate 3, followers 16, links 14, levers 9 and spiral guide 24 of intermediate rotary member 23. When intermediate rotary member 23 is operated by actuator 4 to rotate relative to camshaft 1, phase adjusting linkage 5 is operated in such a manner that followers 16 move along spiral guide 24 and radial guide 8 to be displaced in the radial direction of drive plate 3. The displacement of followers 16 is converted into relative rotation of drive plate 3 and camshaft 1 via links 14. The rotating force of intermediate rotary member 23 is increased to a preset degree through links 14 and levers 9 to thereby apply a relative rotating force to drive plate 3 and camshaft 1.

Actuator 4 of an electromagnetically operated type is used in this embodiment. As illustrated in FIG. 1A, actuator 4 includes permanent magnet block 29 attached to a front surface of intermediate rotary member 23 which is located on the opposite side of drive plate 3. Actuator 4 also includes yoke block 30 integrally connected with lever shaft 10 and electromagnetic coil block 32 disposed within VTC cover 12. Electromagnetic coil block 32 includes a plurality of electromagnetic coils 33A and 33B electrically connected to a controller, not shown, via a drive circuit, not shown, including an excitation circuit, a pulse distribution circuit and the like. The controller receives various input signals indicative of crank angle, cam angle, engine speed, engine load and the like and determines an operating condition of the engine on the basis of the input signals. The controller generates a control signal depending on the operating condition of the engine and transmits the control signal to the drive circuit.

Figure 5:
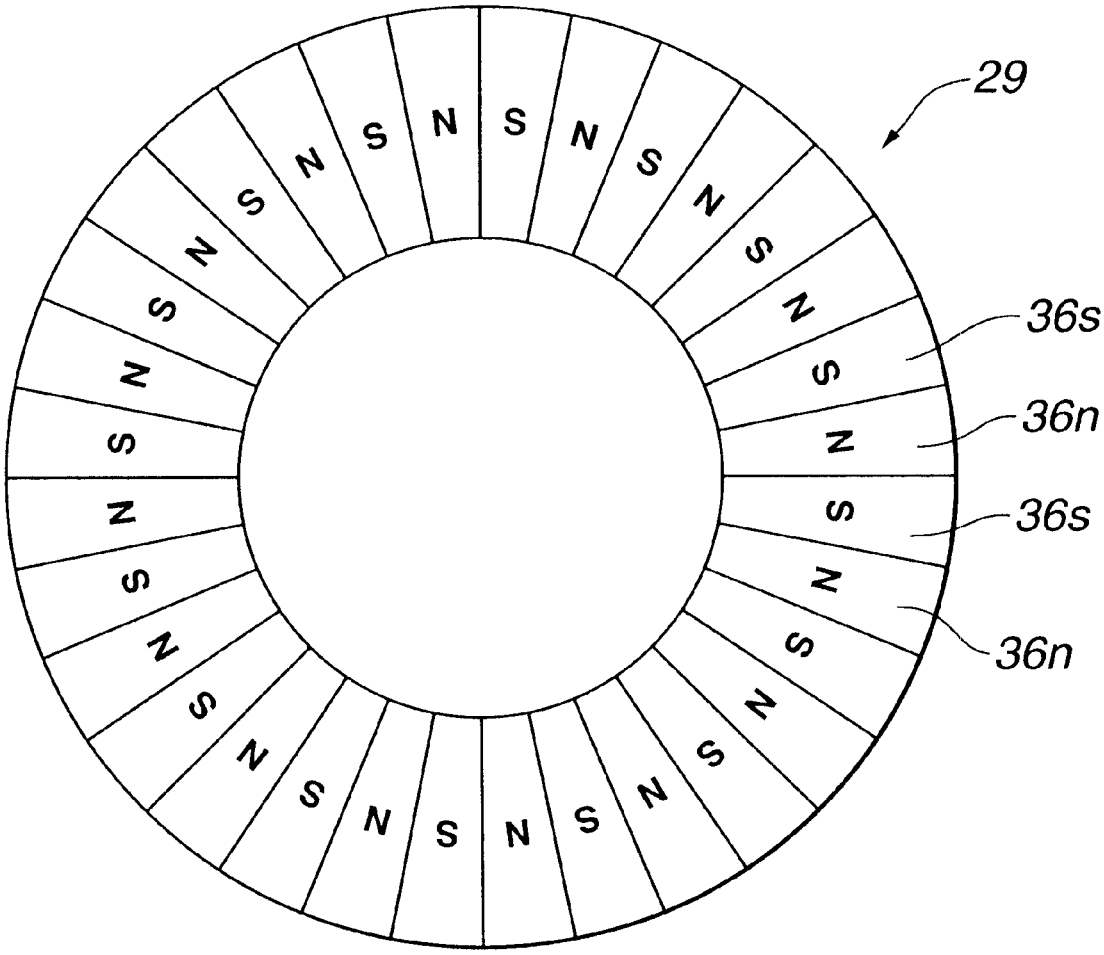
FIG. 5 is a front view of an electromagnetic block of the actuator.

As illustrated in FIG. 5, permanent magnet block 29 has an annular disk-shape and a surface polarized perpendicular to a center axis thereof. The polarized surface includes N-pole faces 36*n* and S-pole faces 36*s* possessing magnetic poles N and S, respectively. N-pole faces 36*n* and S-pole faces 36*s* radially extend and are alternately arranged in a circumferential direction of permanent magnet block 29.

Figure 4:
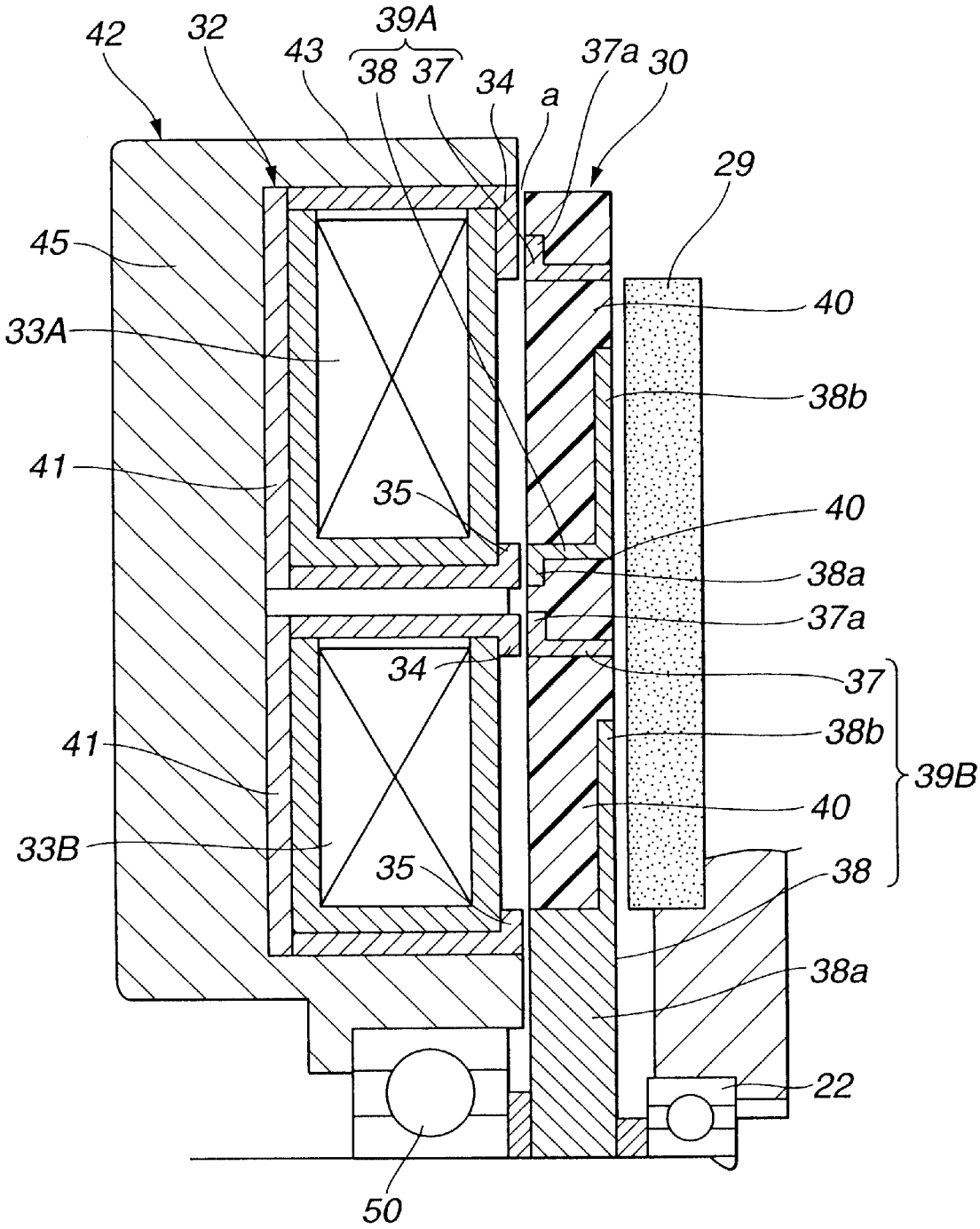
FIG. 4 is an enlarged view of a part of the valve timing control apparatus of the first embodiment, showing an upper half of an electromagnetically operated actuator.
Figure 6:
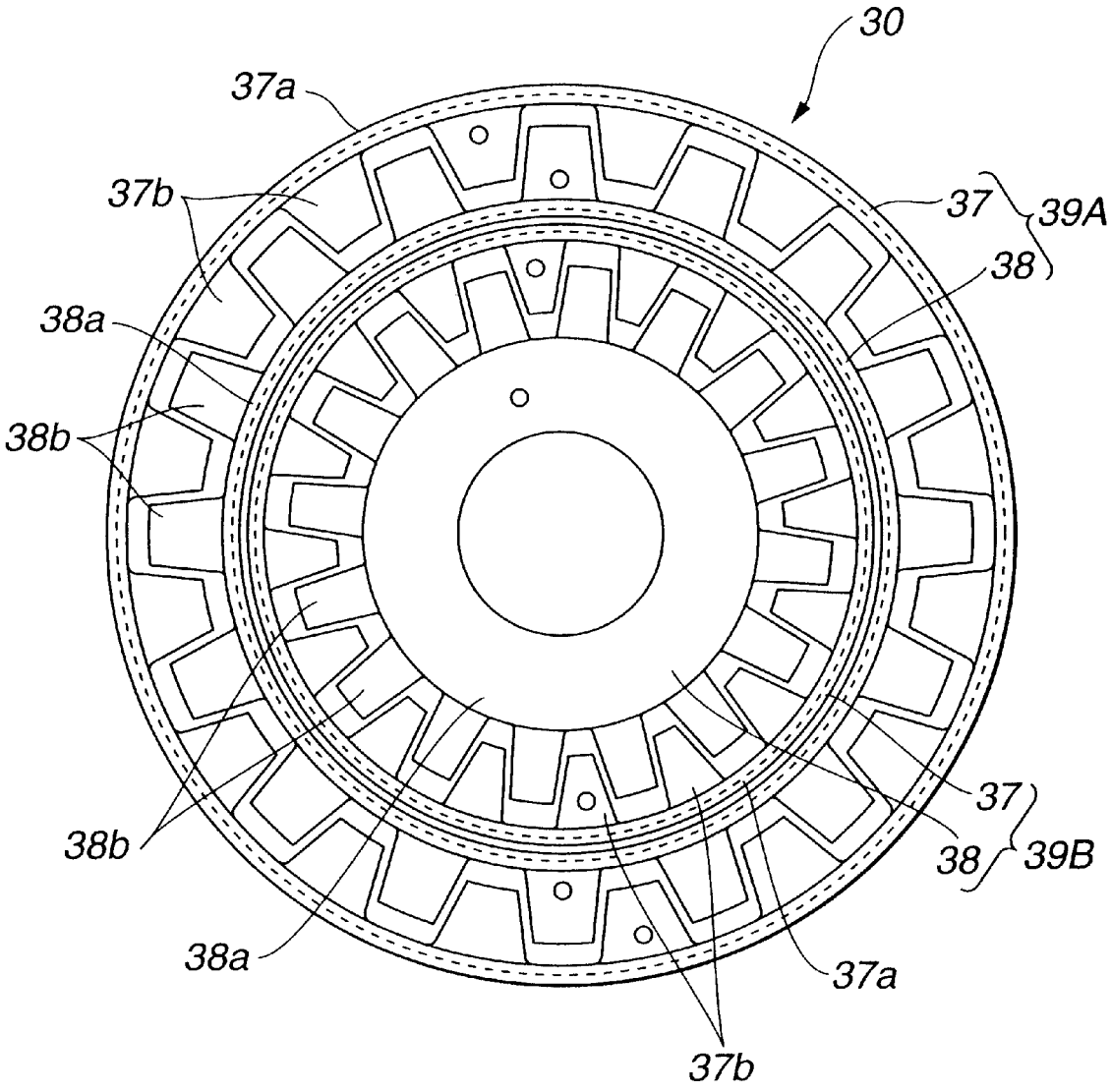
FIG. 6 is a front view of a yoke block of the actuator in which a resin filler is omitted.

As illustrated in FIG. 1, yoke block 30 is integrally connected with lever shaft 10 at an inner circumferential portion thereof. As illustrated in FIGS. 1 and 4, yoke block 30 is opposed to permanent magnet block 29 and electromagnetic coil block 32 on the axially opposite sides thereof. As illustrated in FIG. 6, yoke block 30 has an annular disk-shape and includes a pair of yokes 39A and 39B arranged on the radial outside and inside of yoke block 30, respectively. Each of yokes 39A and 39B is formed by first toothed pole ring 37 and second toothed pole ring 38. First and second toothed pole rings 37 and 38 are made of metal having large magnetic permeability. First toothed pole ring 37 includes generally ring-shaped base portion 37*a* and generally trapezoidal-shaped toothed poles 37*b* radially inward extending from base portion 37*a*. Base portion 37*a* and toothed poles 37*b* are interconnected through a connecting portion bent relative thereto as seen from FIGS. 4 and 6. Second toothed pole ring 38 includes generally ring-shaped base portion 38*a* and generally trapezoidal-shaped toothed poles 38*b* radially outward extending from base portion 38*a*. Base portion 38*a* and toothed poles 38*b* are interconnected through a connecting portion bent relative thereto as seen from FIGS. 4 and 6. Base portions 37*a* and 38*a* are located on the side of electromagnetic coil block 32, namely, on the left side in FIGS. 1 and 4. Toothed poles 37*b* and 38*b* are located on the side of permanent magnet block 29, namely, on the right side in FIGS. 1 and 4. Toothed poles 37*b* are arranged in equidistantly spaced relation to one another in the circumferential direction of first toothed pole ring 37. Toothed poles 38*b* are arranged in equidistantly spaced relation to one another in the circumferential direction of second toothed pole ring 38. Tip ends of toothed poles 37*b* are oriented toward base portions 38*a* of second toothed pole ring 38, while tip ends of toothed poles 38*b* are oriented toward base portions 37*a* of first toothed pole ring 37. Thus, toothed poles 37*b* and 38*b* are alternately arranged in the circumferential direction of first and second toothed pole rings 37 and 38. Toothed poles 37*b* and 38*b* of first toothed pole ring 37 is circumferentially offset from those of second toothed pole ring 38 by ¼ pitch. Insulator 40 made of resin material is filled between first and second toothed pole rings 37 and 38 of each of yokes 39A and 39B and between yokes 39A and 39B.

Figure 7:
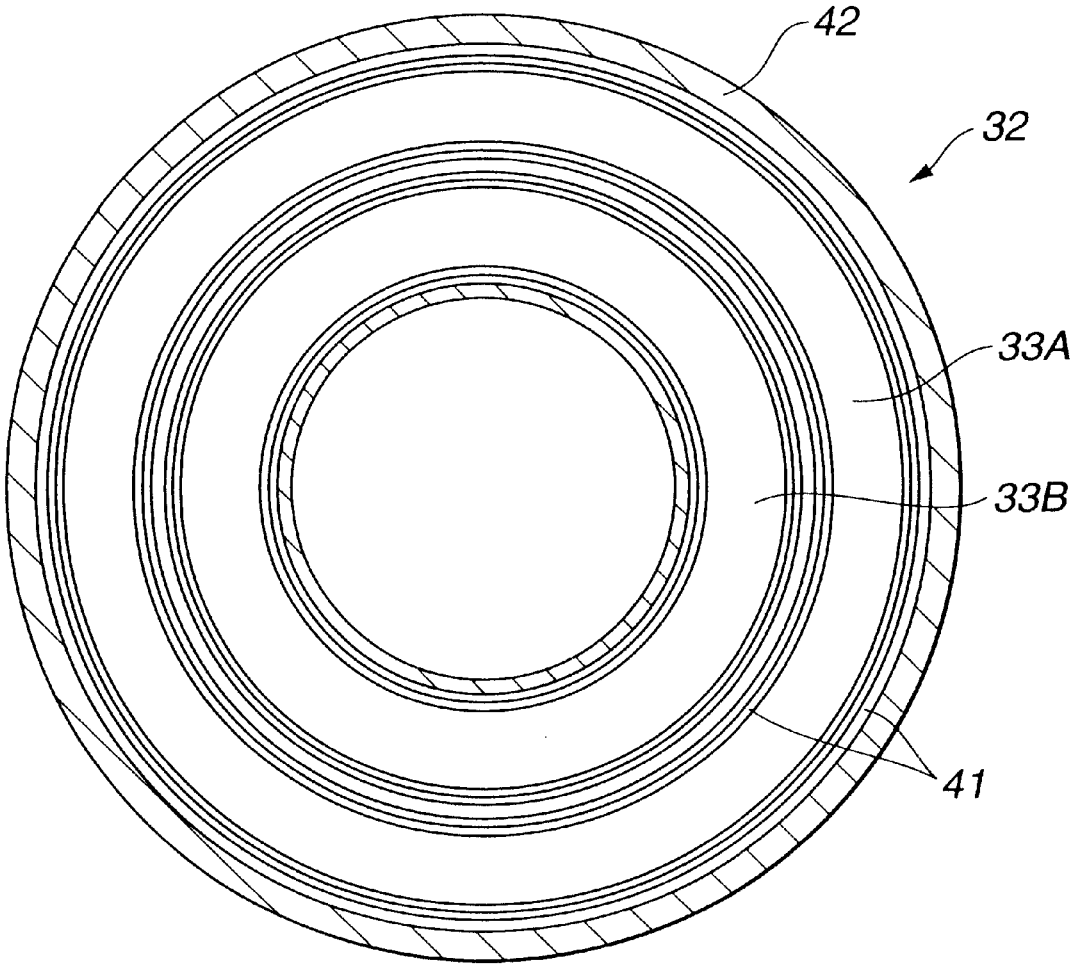
FIG. 7 is a vertical cross-section of an electromagnetic coil block of the actuator.

As illustrated in FIG. 7, electromagnetic coil block 32 includes two-phase electromagnetic coils 33A and 33B which are arranged on the radial outside and inside, respectively. Electromagnetic coils 33A and 33B are separated by yokes 41 extending along peripheries of electromagnetic coils 33A and 33B. Yokes 41 are adapted to induce the magnetic flux generated in electromagnetic coils 33A and 33B in magnetic input and output terminals 34 and 35 which are disposed close to yoke block 30 as shown in FIG. 4. Input and output terminals 34 and 35 are opposed to respective base portions 37*a* and 38*a* of first and second toothed pole rings 37 and 38 of yokes 39A and 39B with axial air gap "a". When electromagnetic coils 33A and 33B are energized to generate magnetic field therein, magnetic induction is produced in the corresponding yokes 39A and 39B so that toothed pole rings 37 and 38 possess the magnetic poles corresponding to the direction of the magnetic field. The direction of the magnetic field generated in electromagnetic coils 33A and 33B is changed in a predetermined pattern relative to pulse input in the drive circuit connected with electromagnetic coils 33A and 33B. This causes the magnetic poles of toothed poles 37*b* and 38*b* opposed to pole faces 36*n* and 36*s* of permanent magnet block 29, to be circumferentially displaced by ¼ pitch each time. Owing to the circumferential displacement of the magnetic poles of toothed poles 37*b* and 38*b* of yoke block 30, intermediate rotary member 23 with permanent magnet block 29 is allowed to rotate relative to lever shaft 10.

As best shown in FIG. 4, support block 42 encloses electromagnetic coil block 32 except input and output terminals 34 and 35 of yokes 41, 41. Support block 42 is made of non-magnetic material such as aluminum. Electromagnetic coil block 32 is mounted to VTC cover 12 through support block 42 as shown in FIG. 1A. Ball bearing 50 is disposed on an inner peripheral surface of support block 42. Support block 42 is rotatably supported on lever shaft 10 via ball bearing 50.

Referring back to FIG. 1A, housing 62 is integrally connected to the front surface of drive plate 3. Housing 62 includes a generally cylindrical wall having open end portion 62*a* on the front side which is open toward intermediate rotary member 23 as shown in FIG. 1B. Open end portion 62*a* surrounds a small-diameter portion of outer ring 23*b* of intermediate rotary member 23 which is located on the side of drive plate 3. Open end portion 62*a* is opposed to the small-diameter portion of outer ring 23*b* with a radial clearance therebetween. Seal member 60 is arranged to seal the radial clearance. In this embodiment, seal member 60 is in the form of a seal ring. Seal member 60 is engaged in annular groove 61 formed in an outer circumferential surface of the small-diameter portion of outer ring 23*b*. Housing 62 and outer ring 23*b* are relatively rotatable while the radial clearance therebetween is kept sealed with seal member 60.

Figure 3:
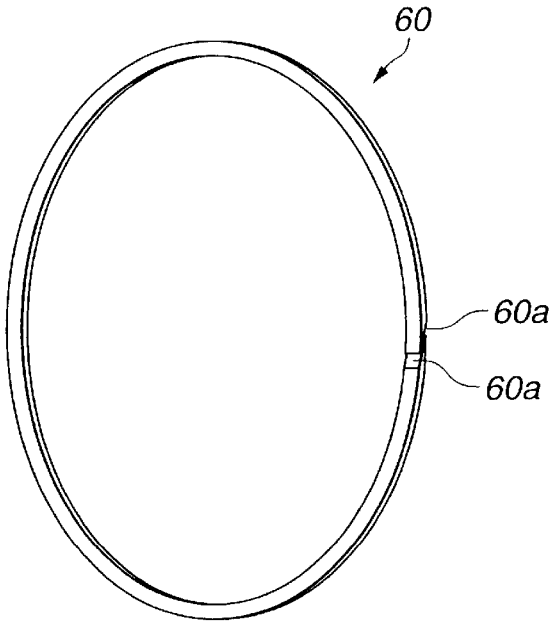
FIG. 3 is a perspective view of a seal member used in the valve timing control apparatus shown in FIGS. 1A and 1B.

Seal member 60 is made of rigid resin material and formed into a generally annular shape. As illustrated in FIG. 3, seal member 60 includes a cut portion defined by cut faces 60*a*, 60*a* which are opposed to each other in a circumferential direction of seal member 60. Cut faces 60*a*, 60*a* are largely inclined relative to an axis of seal member 60. When seal member 60 is mounted into groove 61 of outer ring 23*b* of intermediate rotary member 23, cut faces 60*a*, 60*a* are slided over each other. Seal member 60 is designed to be expandable in a radially outward direction. Seal member 60 is slidably contacted with an inner circumferential surface of open end portion 62*a* of housing 62 under condition that the small-diameter portion of outer ring 23*b* carrying seal member 60 thereon is located in open end portion 62*a*. At this state, cut faces 60*a*, 60*a* are mated with each other so that the cut portion is kept in hermetically sealed.

Housing 62 defines lubricating oil chamber 63 in cooperation with intermediate rotary member 23, drive plate 3, lever shaft 10 and seal member 60. Lubricating oil chamber 63 is arranged to surround the engagement portion between spiral guide 24 and balls 19 of followers 16 and the pivotal connection portions between the one end of links 14 and levers 9 of lever shaft 10 and between the opposite end of links 14 and casing 17 of followers 16. Lubricating oil chamber 63 is always filled with lubricating oil via lubricating oil supply passage 25 in order to ensure the lubrication at the engagement portion and the pivotal connection portions. Even when the lubricating oil within lubricating oil chamber 63 leaks from slight clearances, lubricating oil chamber 63 is supplemented with an amount of lubricating oil from outlet port 25*a* of lubricating oil supply passage 25. The amount of lubricating oil to be supplemented is set larger than the amount of lubricating oil leaking from lubricating oil chamber 63.

In the valve timing control apparatus having the above-described structure, the relative rotational phase of drive plate 3 and lever shaft 10 is preset on the most retardant side as shown in FIG. 2 upon the starting or idling operation of the engine. This allows the relative rotational phase of a crankshaft and camshaft 1 to be adjusted to the most retardant side, so that a stabilized engine revolution and an improved fuel economy can be attained.

In response to shifting from the starting or idling operation of the engine to a normal operation thereof, the controller develops and transmits a control command to the drive circuit of electromagnetic coil block 32 such that the relative rotational phase of a crankshaft and camshaft 1 is changed to the most advance side. Electromagnetic coil block 32 is operated to change the magnetic field generated therein in the predetermined pattern and rotate permanent magnet block 29 together with intermediate rotary member 23 toward the most retardant side. This allows casing 17 of each of followers 16 to radially inward move along radial guide 8 via the position shown in FIG. 8 to the most radial-inside position shown in FIG. 9, while ball 19 of follower 16 being kept in engagement with spiral guide 24. At the most radial-inside position, the relative rotational phase of drive plate 3 and lever shaft 10 is adjusted on the most advance side via links 14 and levers 9. As a result, the relative rotational phase of the crankshaft and camshaft 1 is changed to the most advance side, wherein a power output of the engine can be enhanced.

When the controller develops and transmits a control command to the drive circuit of electromagnetic coil block 32 such that the relative rotational phase of the crankshaft and camshaft 1 is changed from the most advance side to the most retardant side, electromagnetic coil block 32 is operated to change the magnetic field generated therein in an inverse pattern. Intermediate rotary member 23 with permanent magnet block 29 is rotated toward the most advance side. Casing 17 of each of followers 16 is allowed to move along radial guide 8 to the most radial-outside position shown in FIG. 2, while ball 19 thereof is kept in engagement with spiral guide 24. At the most radial-outside position, the relative rotational phase of drive plate 3 and lever shaft 10 is adjusted on the most retardant side via links 14 and levers 9. As a result, the relative rotational phase of the crankshaft and camshaft 1 is changed to the most retardant side.

As described above, the valve timing control apparatus of the invention provides lubricating oil chamber 63 within which the engagement portions between spiral guide 24 and balls 19 and the pivotal connection portions between links 14 and followers 16 and between links 14 and levers 9 can be immersed in lubricating oil. This can always lubricates the engagement portions and the pivotal connection portions, ensuring the lubrication thereof. Further, owing to a damping function of the lubricating oil within lubricating oil chamber 63, the valve timing control apparatus of the invention can prevent the occurrence of such vibration and noise in the clearance between the spiral guide and followers 16 and the clearance between the links and followers 16 and between the links and the levers as described in the related art. Furthermore, since seal member 60 is disposed in the clearance between relatively rotatable housing 62 and intermediate rotary member 23, the lubricating oil within lubricating oil chamber 63 can be prevented from leaking from the clearance. Further, lubricating oil chamber 63 can be supplemented with the amount of lubricating oil which is larger than the amount of lubricating oil leaking from lubricating oil chamber 63, from outlet port 25*a* of lubricating oil supply passage 25. Therefore, lubricating function and damping function of the lubricating oil can be stably performed.

Figure 10:
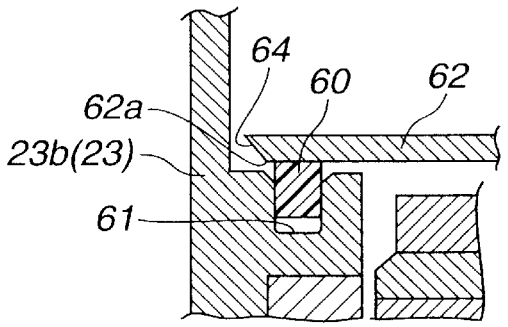
FIG. 10 is an enlarged cross-section of a modification of the valve timing control apparatus of the first embodiment.

FIG. 10 illustrates a modification of housing 62, in which open end portion 62*a* has radially inward inclined surface 64 at a distal end thereof. With the provision of slant surface 64, seal member 60 is readily brought into a radially inward contracted state by being urged onto inclined surface 64 upon insertion into open end portion 62*a*.

Figure 11:
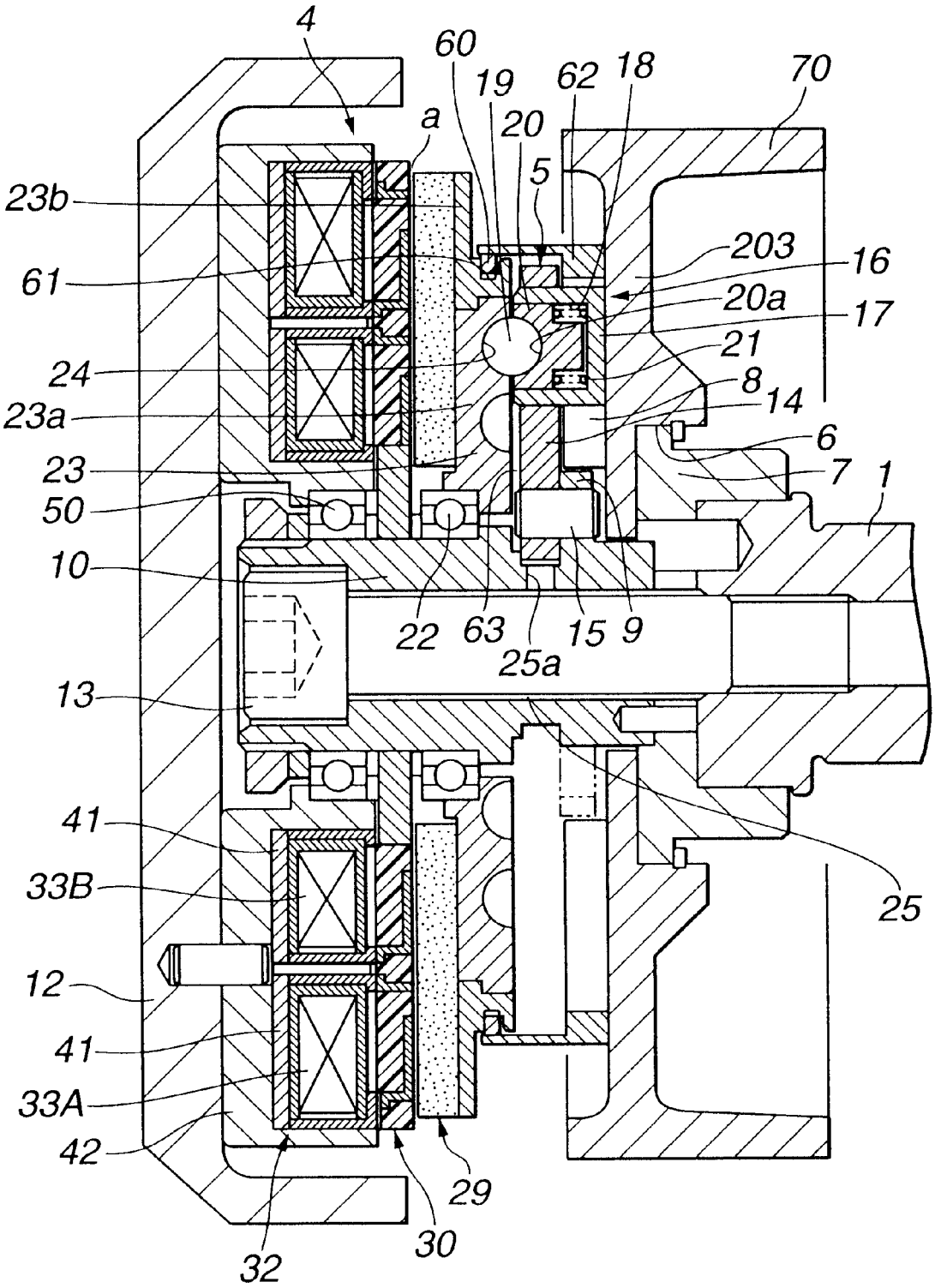
FIGS. 11–13 are vertical cross-sections of a valve timing control apparatus according to second, third and fourth embodiments of the present invention, respectively.

Referring to FIG. 11, a second embodiment of the invention will be explained hereinafter, which differs from the first embodiment in that drive plate 203 is formed as a pulley. Like reference numerals denote like parts, and therefore, detailed explanations therefor are omitted. As illustrated in FIG. 11, drive plate 203 has widened rim 70 on the outer periphery. A belt made of rubber is wound on rim 70 to drivably connect drive plate 203 with the engine crankshaft. Similar to the first embodiment, the clearance between relatively rotatable housing 62 and intermediate rotary member 23 is hermetically sealed with seal member 60. The rubber belt, therefore, can be prevented from adherence of the lubricating oil leaking from the clearance and can be inhibited from being deteriorated due to the oil adherence.

Figure 12:
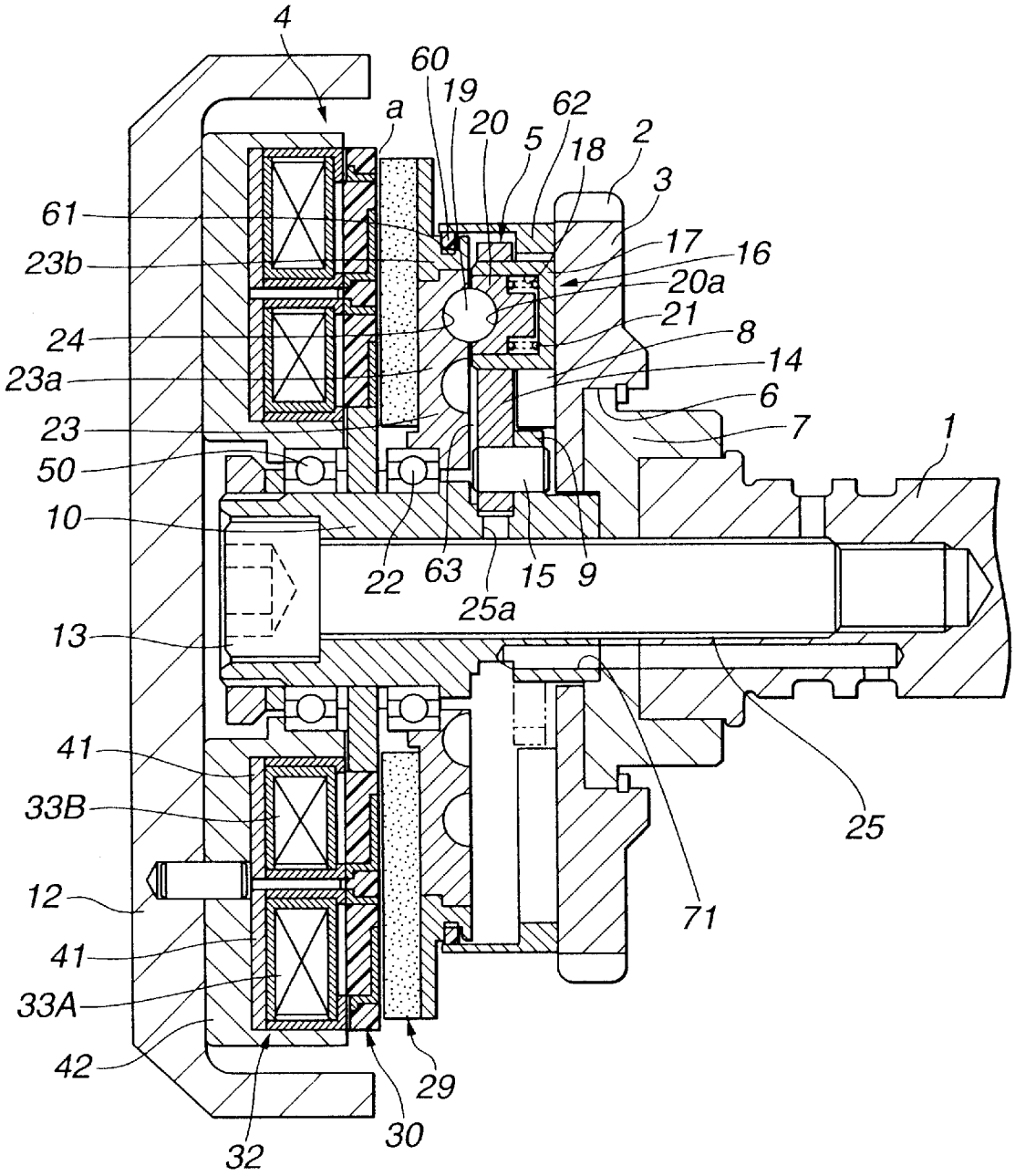

Referring to FIG. 12, a third embodiment of the invention will be explained hereinafter. In the third embodiment, lubricating oil discharge passage 71 is provided in addition to lubricating oil supply passage 25. As illustrated in FIG. 12, lubricating oil discharge passage 71 extends from lever shaft 10 into camshaft 1 through flange ring 7. Lubricating oil discharge passage 71 is open to the outer circumferential surface of lever shaft 10. With the provision of lubricating oil discharge passage 71, the lubricating oil introduced into lubricating oil chamber 63 via lubricating oil supply passage 25 is circulated within lubricating oil chamber 63 and then discharged from lubricating oil discharge passage 71 to the outside of the valve timing control apparatus. The lubricating oil can be prevented from staying within lubricating oil chamber 63, and therefore, can be inhibited from being deteriorated. Further, if foreign substance is mixed into the lubricating oil within lubricating oil chamber 63, the foreign substance can be discharged from lubricating oil chamber 63 together with the lubricating oil. The foreign substance may be scrap powder of the materials of the components surrounded by the lubricating oil within lubricating oil chamber 63, which is produced due to abrasion.

Figure 13:
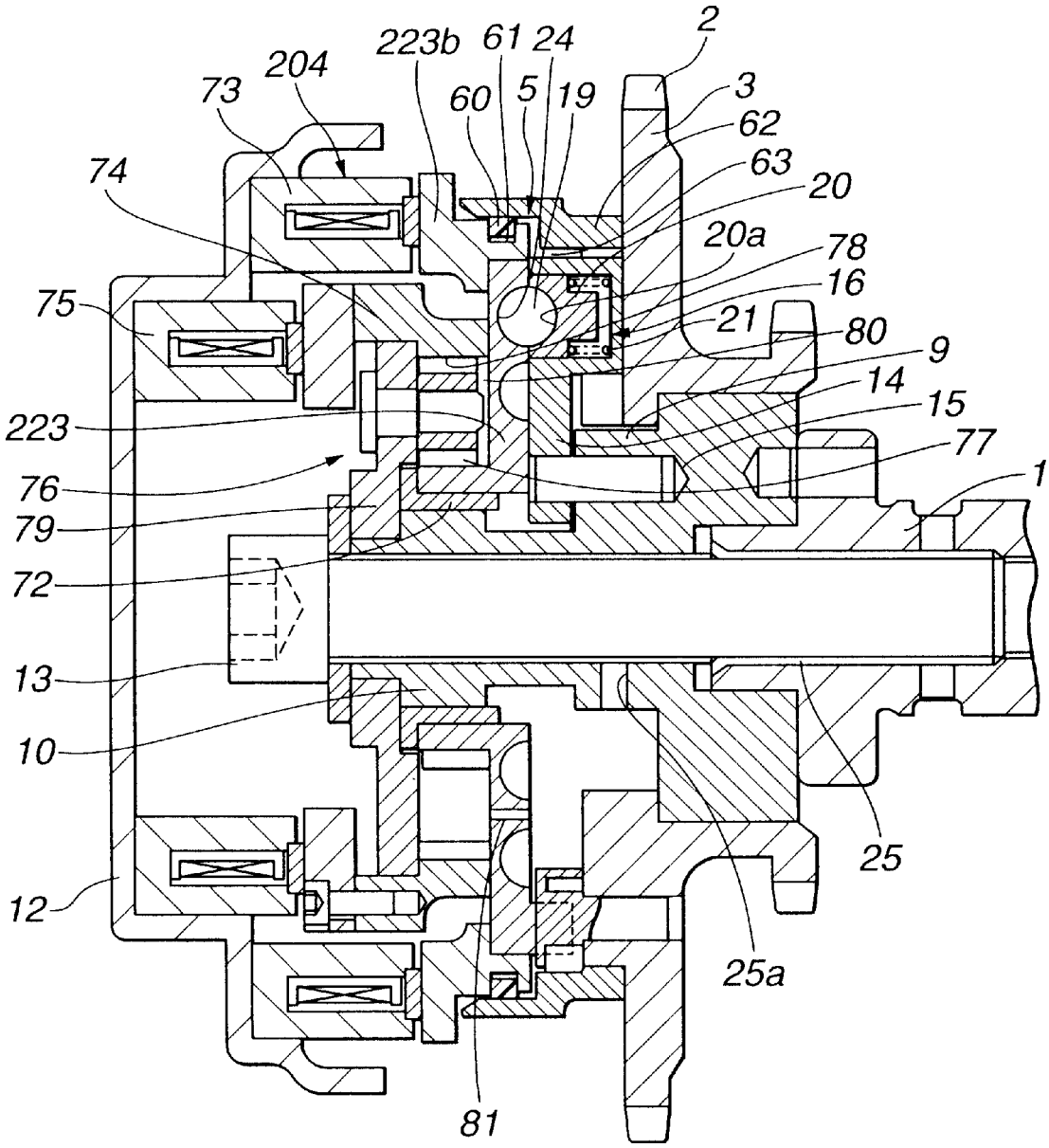
Figure 14:
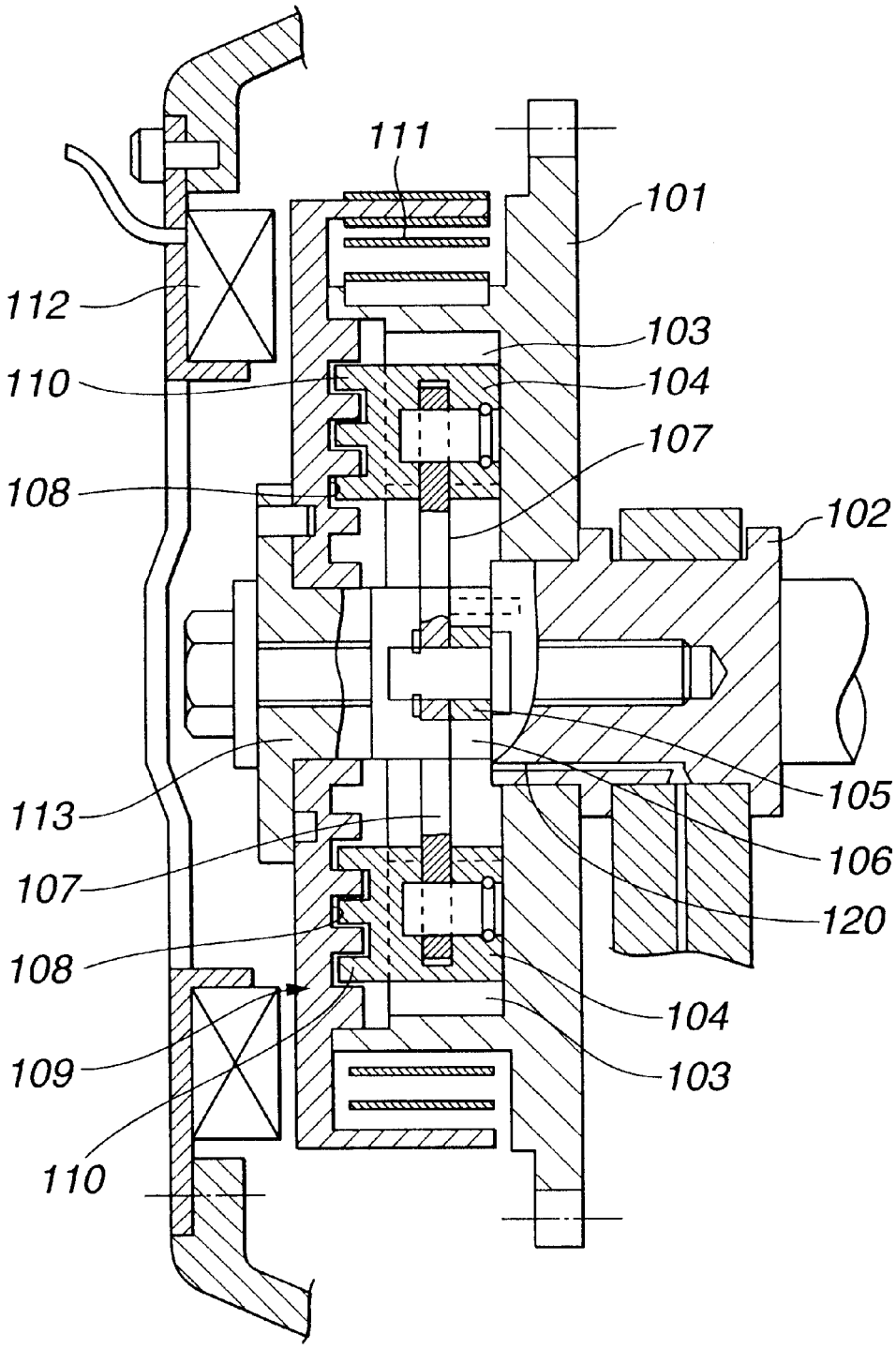
FIG.14 (RELATED ART)
FIG. 14 is a vertical cross-section of a valve timing control apparatus of a related art.
Figure 15:
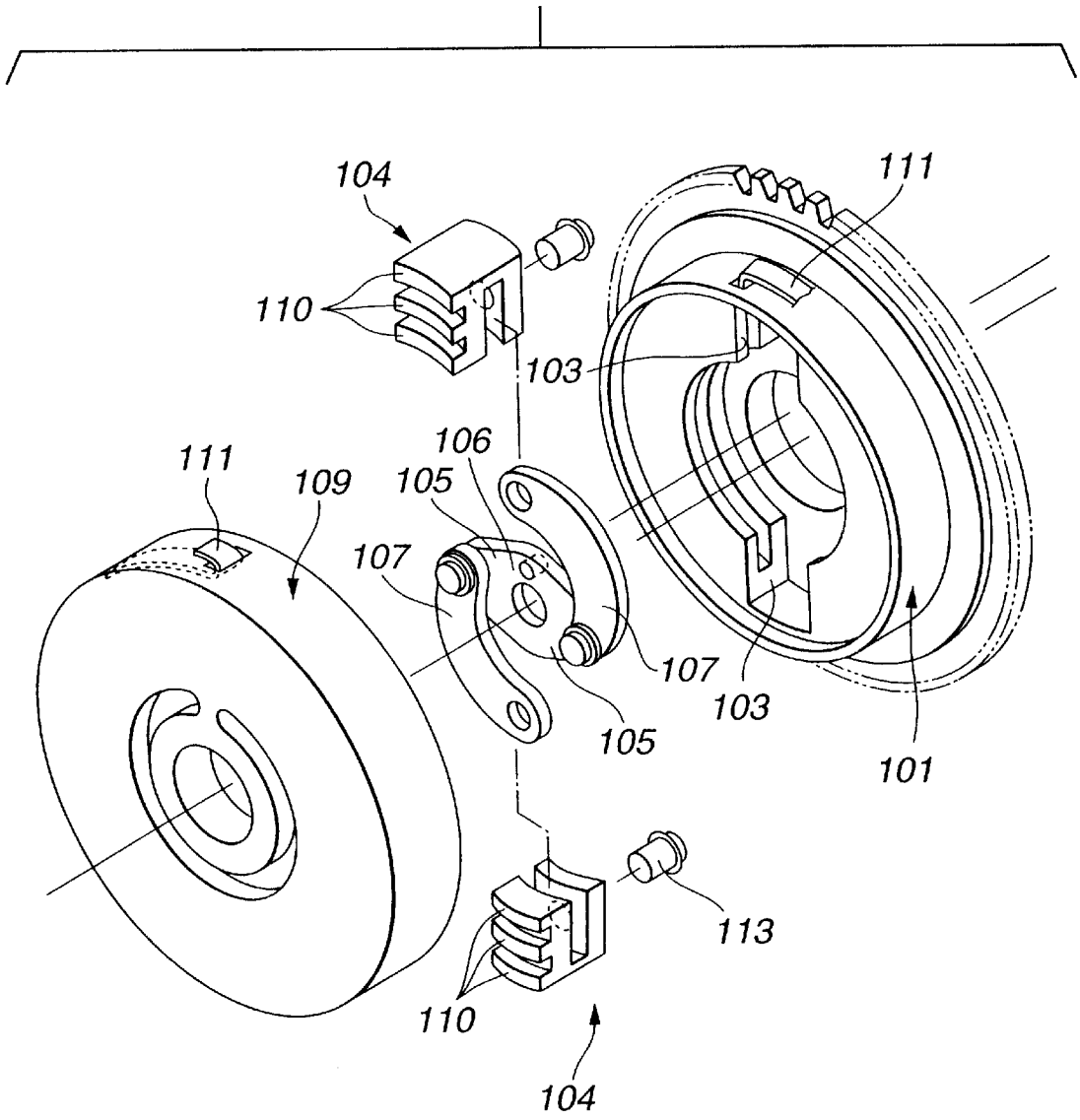
FIG.15 (RELATED ART)
FIG. 15 is an exploded perspective view of a part of the valve timing control apparatus of the related art.

Referring to FIG. 13, a fourth embodiment of the invention will be explained hereinafter, which differs from the first embodiment in arrangement of actuator 204 for phase adjusting linkage 5 and in provision of passage 81 for supplying lubricating oil to gear train 76 of actuator 204. As illustrated in FIG. 13, actuator 204 includes first electromagnetic brake 73 for braking intermediate rotary member 223. Intermediate rotary member 223 is the same as intermediate rotary member 23 of the first embodiment except that outer ring 223*b* extends from the radially outer periphery of the disk-shaped main body in the frontward direction and that an inner sleeve extends from the radially inner periphery of the disk-shaped main body in the frontward direction. Intermediate rotary member 223 is rotatably supported on lever shaft 10 via bearing 72 disposed inside the inner sleeve. First electromagnetic brake 73 is arranged in axially opposed relation to a front end surface of outer ring 223*b*. Actuator 204 also includes actuating rotary member 74 rotatably disposed on the side of the front end of lever shaft 10, and second electromagnetic brake 75 for braking actuating rotary member 74. Actuating rotary member 74 having a generally annular shape is disposed between outer ring 223*b* and the inner sleeve of intermediate rotary member 223. Actuating rotary member 74 includes axially opposed end surfaces, namely, a front end surface opposed to second electromagnetic brake 75 and a rear end surface opposed to intermediate rotary member 223. First and second electromagnetic brakes 73 and 75 are fixed to an inner surface of VTC cover 12. First and second electromagnetic brakes 73 and 75 have a generally annular shape as a whole and substantially the same structure. Second electromagnetic brake 75 is arranged on the radial inside of first electromagnetic brake 73. First and second electromagnetic brakes 73 and 75 are selectively operated by energization to generate an electromagnetic force as a braking force. First and second electromagnetic brakes 73 and 75 are switchable between ON position where the braking force is applied to intermediate rotary member 223 and actuating rotary member 74 and OFF position where the braking force is cancelled.

Actuator 204 further includes gear train 76 operative to change the direction of rotation of intermediate rotary member 223 from one direction to an opposite direction depending on the selective operation of first and second electromagnetic brakes 73 and 75. In this embodiment, gear train 76 is in the form of a planetary gear train as follows. Sun gear 77 is integrally formed on an outer circumferential surface of the sleeve portion of intermediate rotary member 223. Ring gear 78 is integrally formed on an inner circumferential surface of the rear side of actuating rotary member 74. Generally disk-shaped carrier plate 79 is fixed to the front end portion of lever shaft 10. A plurality of planetary gears 80 are rotatably supported on carrier plate 79 and meshed with sun gear 77 and ring gear 78.

When ring gear 78 of actuating rotary member 74 is in a free-rotating state and planetary gears 80 rotate about sun gear 77 of intermediate rotary member 223 together with carrier plate 79 without rotating about the center axes thereof, ring gear 74 and sun gear 77 each meshed with planetary gears 80 are allowed to rotate at an identical speed. In this condition, if only ring gear 78 is braked, ring gear 78 will be rotated in the retardant direction relative to carrier plate 79 so that planetary gears 80 will rotate about the center axes thereof. This allows sun gear 77 to rotate at an increase speed, whereby intermediate rotary member 223 can be rotated in an advance direction relative to drive plate 3.

Thus-constructed actuator 204 operates in the following manner. When first electromagnetic brake 73 is energized to generate a braking force applied to intermediate rotary member 223, the rotating speed of intermediate rotary member 223 is reduced so that intermediate rotary member 223 is rotated in a retardant direction relative to drive plate 3. On the other hand, when second electromagnetic brake 75 is energized to generate a braking force applied to actuating rotary member 74, the rotating speed of intermediate rotary member 223 is increased so that intermediate rotary member 223 is rotated in an advance direction relative to drive plate 3.

Intermediate rotary member 223 has passage 81 for introducing lubricating oil from lubricating oil chamber 63 to gear train 76. Passage 81 is in the form of a through-hole axially extending through intermediate rotary member 223 from the rear surface to the front surface. Passage 81 has an inlet open to lubricating oil chamber 63 and an outlet opposed to planetary gears 80. Specifically, the outlet of passage 81 is located in substantially opposed relation to an orbit of rotation of planetary gears 80. With the provision of passage 81, the lubricating oil passing through passage 81 can be efficiently supplied to the mutually meshing portions between planetary gears 80 and sun gear 77 and between planetary gears 80 and ring gear 78. Lubrication of gear train 76 thus can be ensured. Further, passage 81 is readily produced, and therefore, the production cost can be saved. Otherwise, if a passage for supplying lubricating oil to gear train 76 is formed in lever shaft 10, a radially extending passage must be formed with high accuracy by complicated machining.

With the provision of lubricating oil chamber 63, the valve timing control apparatuses of the second to fourth embodiments have the effects of lubricating the engagement portion between spiral guide 24 and balls 19 and the pivotal connection portions between links 14 and followers 16 and between links 14 and lever shaft 10 and the effects of suppressing the occurrence of vibration and noise, as described in the first embodiment.

Meanwhile, the gear train for changing the direction of rotation of intermediate rotary member 223 is not limited to planetary gear train 76. Other types of gear trains may be applied to the valve timing control apparatus of the invention.

This application is based on prior Japanese Patent Application No. 2001-315061 filed on Oct. 12, 2001, the entire content of which is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve timing control apparatus for an internal combustion engine, comprising:

a drive rotary member adapted to be rotatively coupled with the engine;

a driven rotary member rotatably coupled with the drive rotary member;

an intermediate rotary member arranged to be rotatable relative to the drive rotary member and the driven rotary member;

a radial guide extending on one of the drive rotary member and the driven rotary member in a radial direction thereof;

a spiral guide disposed on the intermediate rotary member in an opposed relation to the radial guide;

a follower moveably engaged with the radial guide and the spiral guide;

a link coupling the follower with a radially outer periphery of the other of the drive rotary member and the driven rotary member, the link comprising one end pivotally connected with the radially outer periphery of the other of the drive rotary member and the driven rotary member and an opposite end pivotally connected with the follower;

an actuator operative to rotate the intermediate rotary member so as to allow a movement of the follower along the radial guide which is converted into relative rotation of the drive rotary member and the driven rotary member via the link; and a lubricating oil chamber arranged to surround an engagement portion between the spiral guide and the follower and pivotal connection portions between the one end of the link and the radially outer periphery of the other of the drive rotary member and the driven rotary member and between the opposite end of the link and the follower, the lubricating oil chamber being adapted to be filled with lubricating oil.

2. The valve timing control apparatus as claimed in claim 1, further comprising a housing integrally connected on the one of the drive rotary member and the driven rotary member and opposed to the intermediate rotary member with a clearance therebetween, and a seal member arranged to seal the clearance, the housing and the seal member cooperating with the one of the drive rotary member and the driven rotary member and the intermediate rotary member to define the lubricating oil chamber.

3. The valve timing control apparatus as claimed in claim 2, wherein the housing comprises an open end portion open toward the intermediate rotary member, the clearance being a radial clearance between the open end portion of the housing and an outer periphery of the intermediate rotary member, the housing being rotatable relative to the intermediate rotary member while the clearance is kept sealed with the seal member.

4. The valve timing control apparatus as claimed in claim 1, further comprising a lubricating oil supply passage communicated with the lubricating oil chamber, the lubricating oil supply passage allowing the lubricating oil chamber to be supplied with the lubricating oil upon occurrence of leakage of the lubricating oil from the lubricating oil chamber.

5. The valve timing control apparatus as claimed in claim 1, further comprising a lubricating oil supply passage and a lubricating oil discharge passage which are communicated with the lubricating oil chamber, the lubricating oil supply passage allowing the lubricating oil chamber to be supplied with the lubricating oil, the lubricating oil discharge passage allowing the lubricating oil to be discharged from the lubricating oil chamber.

6. The valve timing control apparatus as claimed in claim 1, wherein the actuator is an electromagnetically operated actuator.

7. The valve timing control apparatus as claimed in claim 1, wherein the actuator comprises a first electromagnetic brake, a second electromagnetic brake, the first and second electromagnetic brakes being selectively operative to generate an electromagnetic force, and a gear train operative to change a direction of rotation of the intermediate rotary member between one direction and an opposite direction depending on the selective operation of the first and second electromagnetic brakes.

8. The valve timing control apparatus as claimed in claim 7, wherein the intermediate rotary member is formed with a through-hole through which the lubricating oil is introduced from the lubricating oil chamber to the gear train.

9. The valve timing control apparatus as claimed in claim 4, wherein the lubricating oil supply passage extends through the driven rotary member along a rotation axis of the driven rotary member, the lubricating oil supply passage comprising an outlet port open to an outer surface of the radially outer periphery of the other of the drive rotary member and the driven rotary member.

10. The valve timing control apparatus as claimed in claim 5, wherein the lubricating oil supply passage extends through the driven rotary member along a rotation axis of the driven rotary member, the lubricating oil supply passage comprising an outlet port open to an outer surface of the radially outer periphery of the other of the drive rotary member and the driven rotary member, the lubricating oil discharge passage extending in the driven rotary member.

11. The valve timing control apparatus as claimed in claim 2, wherein the intermediate rotary member is formed with a circumferential groove circumferentially extending on an outer peripheral surface thereof, the seal member comprising a seal ring which is engaged in the groove and slidably contacted with a circumferential inner surface of the open end portion of the housing.

12. The valve timing control apparatus as claimed in claim 1, wherein the drive rotary member comprises a timing sprocket adapted to be drivably connected with a crankshaft in the engine.

13. The valve timing control apparatus as claimed in claim 1, wherein the driven rotary member is coupled with a camshaft drivably connected with the engine.

14. The valve timing control apparatus as claimed in claim 13, wherein the driven rotary member comprises a radial projection radially outward extending from the radially outer periphery of the driven rotary member, the link comprising one end pivotally supported at the radial projection of the driven rotary member and an opposite end at which the follower is rotatably supported.

15. The valve timing control apparatus as claimed in claim 1, wherein the follower comprises a casing, a retainer slidably disposed within the casing, a spring biasing the retainer toward the spiral guide, and a ball rotatably supported between the retainer and the spiral guide.

16. The valve timing control apparatus as claimed in claim 7, wherein the actuator comprises an actuating rotary member rotatably disposed on an axial end portion of the driven rotary member, the actuating rotary member comprising one axial end surface opposed to the second electromagnetic brake and an opposite axial end surface opposed to the intermediate rotary member.

17. The valve timing control apparatus as claimed in claim 16, wherein the first electromagnetic brake is arranged opposed to the intermediate rotary member, the second electromagnetic brake being arranged on a radial inside of the first electromagnetic brake.

18. The valve timing control apparatus as claimed in claim 16, wherein the gear train comprises a planetary gear train disposed on the axial end portion of the driven rotary member.

19. A valve timing control apparatus for an internal combustion engine, comprising:

a drive rotary member adapted to be rotatively coupled with the engine;

a driven rotary member rotatably coupled with the drive rotary member;

an intermediate rotary member arranged to be rotatable relative to the drive rotary member and the driven rotary member;

a radial guide extending on one of the drive rotary member and the driven rotary member in a radial direction thereof;

a spiral guide disposed on the intermediate rotary member in an opposed relation to the radial guide;

a follower moveably engaged with the radial guide and the spiral guide;

a link coupling the follower with a radially outer periphery of the other of the drive rotary member and the driven rotary member, the link comprising one end pivotally connected with the radially outer periphery of the other of the drive rotary member and the driven rotary member and an opposite end pivotally connected with the follower;

an actuator operative to rotate the intermediate rotary member so as to allow a movement of the follower along the radial guide which is converted into relative rotation of the drive rotary member and the driven rotary member via the link; and a lubricating oil chamber arranged to surround an engagement portion between the spiral guide and the follower and pivotal connection portions between the one end of the link and the radially outer periphery of the other of the drive rotary member and the driven rotary member and between the opposite end of the link and the follower, the lubricating oil chamber being adapted to be filled with lubricating oil and supplied with an amount of lubricating oil larger than an amount of lubricating oil leaking therefrom.

20. A valve timing control apparatus for an internal combustion engine, comprising:

a drive rotary member adapted to be rotatively coupled with the engine;

a driven rotary member rotatably coupled with the drive rotary member;

an intermediate rotary member arranged to be rotatable relative to the drive rotary member and the driven rotary member;

phase adjusting linkage means for coupling the drive rotary member and the driven rotary member and adjusting a relative rotational phase of the drive rotary member and the driven rotary member;

actuator means for operating the intermediate rotary member to allow the adjustment of the relative rotational phase via the phase adjusting linkage means; and wall means for defining a lubricating oil chamber in cooperation with the intermediate rotary member and one of the drive rotary member and the driven rotary member, the phase adjusting linkage means being disposed within the lubricating oil chamber.

21. The valve timing control apparatus as claimed in claim 20, further comprising seal means for sealing a clearance defined between the wall means and the intermediate rotary member.

22. The valve timing control apparatus as claimed in claim 21, wherein the seal means comprises a seal ring.

23. The valve timing control apparatus as claimed in claim 20, further comprising lubricating oil supply passage means for supplying the lubricating oil chamber with lubricating oil.

24. The valve timing control apparatus as claimed in claim 23, wherein an amount of lubricating oil to be supplied to the lubricating oil chamber is set larger than an amount of lubricating oil leaking from the lubricating oil chamber.

* * * * *